US005889249A

United States Patent [19]

Rival et al.

[11] Patent Number: 5,889,249

[45] Date of Patent: Mar. 30, 1999

[54] TIGHTLY JOINED WIRE MESH DEIONIZING DEVICE FOR A CURRENT BREAKER

[75] Inventors: Marc Rival, Panissage; Christophe Kilindjian, Meylan; Yves Clery, Voiron; Serge Bonente, Crolles, all of France

[73] Assignee: Schneider Electric SA, France

[21] Appl. No.: 869,915

[22] Filed: Jun. 5, 1997

[30] Foreign Application Priority Data

Jun. 28, 1996 [FR] France ..... 96 08301

[51] Int. Cl.[6] ..... H01H 9/30; H01H 33/04

[52] U.S. Cl. ..... 218/149; 218/150; 218/156; 218/157

[58] Field of Search ..... 218/15, 33–41, 218/149, 150, 151, 155–158; 335/201, 16, 147

[56] References Cited

U.S. PATENT DOCUMENTS

| | | | |
|---|---|---|---|
| 3,786,380 | 1/1974 | Harper | 335/201 X |
| 3,997,746 | 12/1976 | Harper et al. | 218/149 |
| 4,370,636 | 1/1983 | Van Pattern | 218/31 X |
| 4,511,772 | 4/1985 | Link et al. | 218/149 |
| 4,733,032 | 3/1988 | Pardini | 218/150 |
| 4,748,301 | 5/1988 | Goldman et al. | 218/150 |
| 4,982,174 | 1/1991 | Fasano | 218/149 X |
| 5,731,561 | 3/1998 | Manthe et al. | 218/35 |

FOREIGN PATENT DOCUMENTS

| | | | |
|---|---|---|---|
| 22708 | 10/1983 | European Pat. Off. | H01H 73/18 |
| 2508230 | 12/1982 | France | H01H 71/02 |
| 3541514 | 5/1987 | Germany | H01H 33/04 |

*Primary Examiner*—J. R. Scott
*Attorney, Agent, or Firm*—Parkhurst & Wendel

[57] ABSTRACT

The invention relates to a gas deionization device and an arc extinguishing chamber notably for a multipole low voltage circuit breaker with a molded case. A porous shield comprising one or more superposed metallic wire cloths. Each cloth is formed by a criss-crossing of straight wire yarns spaced apart from and parallel to one another with tight joined undulated wire yarns that extend appreciably perpendicular to the straight wire yarns, and pass alternately over and under at least one of the successive straight wire yarns. At least three superposed wire cloths have progressive mesh openings.

13 Claims, 4 Drawing Sheets

TIGHTLY JOINED WIRE MESH DEIONIZING DEVICE FOR A CURRENT BREAKER

BACKGROUND OF THE INVENTION

The present invention relates to a gas deionization device notably designed to be placed in the zone of the outlet orifice of an arc extinguishing chamber of a multipole low voltage circuit breaker with a molded case, and an arc extinguishing chamber equipped with this device.

Devices are known comprising fine-mesh metallic grates or shields, notably made of steel, housed in the outlet orifices of circuit breaker arc extinguishing chambers. The breaking gases are generated in the arc extinguishing chamber when circuit breaking takes place. The breaking gases are passed to the outside environment after passing through the grates acting as flame protection shields. It has however been observed that these gases were still highly ionized when outlet from the arc extinguishing chamber.

In order to improve deionization by cooling the breaking gases, other deionization devices have been previously proposed, notably a labyrinth formed by a plurality of shields with offset windows, a reflecting grate etc., but the large size of these devices does not enable them to be used in compact arc extinguishing chambers for molded case circuit breakers.

The European Patent EP 0,022,708 describes a deionization device comprising a porous shield formed from agglomerated balls made from a copper base. Gaps are arranged between the balls to enable the breaking gases to pass to the outside environment. This device of compact structure enables a relatively efficient cooling of the breaking gases ventilated from an arc extinguishing chamber with a high breaking capacity to be achieved.

SUMMARY OF THE INVENTION

The present invention proposes an improved deionization device of compact structure enabling an even more efficient cooling of the breaking gases that are vented to the outside environment, so as to reduce external manifestations.

This device is designed to be incorporated in an arc extinguishing chamber with a high breaking capacity and presents a structure adapted according to the arcing energy developed in said chamber.

For this purpose, the object of the present invention is to provide a gas deionization device comprising a porous shield notably designed to be arranged near to the outlet orifice of the arc extinguishing chamber of a low voltage circuit breaker to perform cooling of the breaking gases generated when separation of the contacts takes place after the circuit breaker has tripped, this device being characterized in that the above-mentioned porous shield comprises at least a wire cloth called reps comprising a crossed texture of straight wire yarns spaced apart from and parallel to one another with tight joined undulated wire yarns. The said undulated wire yarns extend appreciably perpendicularly to said straight wire yarns and pass alternately over and under at least one of the successive straight wire yarns.

According to a particular feature, the above-mentioned cloth(s) is (are) made of a corrosion-resistant metallic material such as stainless steel or nickel.

According to a particular embodiment, each cloth comprises meshes of appreciably triangular shape designed for passage of the gas and each defined by a straight wire yarn and two undulated wire yarns tangent to one another in the mid-plane of the cloth.

According to a particular embodiment, at least one of the above-mentioned cloths comprises undulated wire yarns passing alternately over and under one single straight wire yarn at a time, and arranged two by two so that when one passes over a straight wire yarn, the other one passes under this same straight wire yarn.

According to another particular embodiment, at least one of the above-mentioned cloths comprises undulated wire yarns passing alternately under and over two straight wire yarns at a time, each time with an offset of a straight wire yarn with respect to the previous undulated wire yarn, the undulated wire yarns being imbricated.

Advantageously, the undulated wire yarns are the weft yarns.

According to another feature, the diameter of the undulated wire yarns is smaller than that of the straight wire yarns.

According to another feature, it comprises at least two superposed cloths having mesh openings of different size.

Advantageously, it comprises at least three superposed cloths having progressive mesh openings, the cloth presenting the largest mesh openings called the first cloth being passed through first by the gases.

Advantageously, the above-mentioned first cloth presents a diameter of undulated and straight yarns greater than 0.5 mm and a nominal opening greater than 400 $\mu$m, whereas the last cloth presents a nominal opening smaller than 200 $\mu$m.

The object of the invention is also to achieve an arc extinguishing chamber notably for a multipole low voltage circuit breaker with an isolating molded case, comprising per pole: a pair of stationary and movable separable contacts, an actuating mechanism of the movable contact, metallic plates for cooling of the arc drawn between said contacts when the latter separate, an orifice for outlet of the breaking gases arranged in the case at the outlet of said chamber and a deionization device, comprising the previous features taken alone or in combination, arranged near to said outlet orifice to cool the breaking gases outlet to the outside environment.

According to a particular feature, this chamber comprises in addition at least one additional perforated shield made of insulating material placed between the ends of the above-mentioned cooling plates and the porous shield.

According to another feature, this chamber comprises in addition perforated plates or stiffeners placed on each side of the porous shield to increase its mechanical resistance to the pressure wave.

BRIEF DESCRIPTION OF THE DRAWINGS

But other advantages and features of the invention will become more clearly apparent from the following detailed description which refers to the accompanying drawings given to serve as examples only and in which.

DETAILED DESCRIPTION OF THE PREFERRED EMBODIMENT

Figure 1:
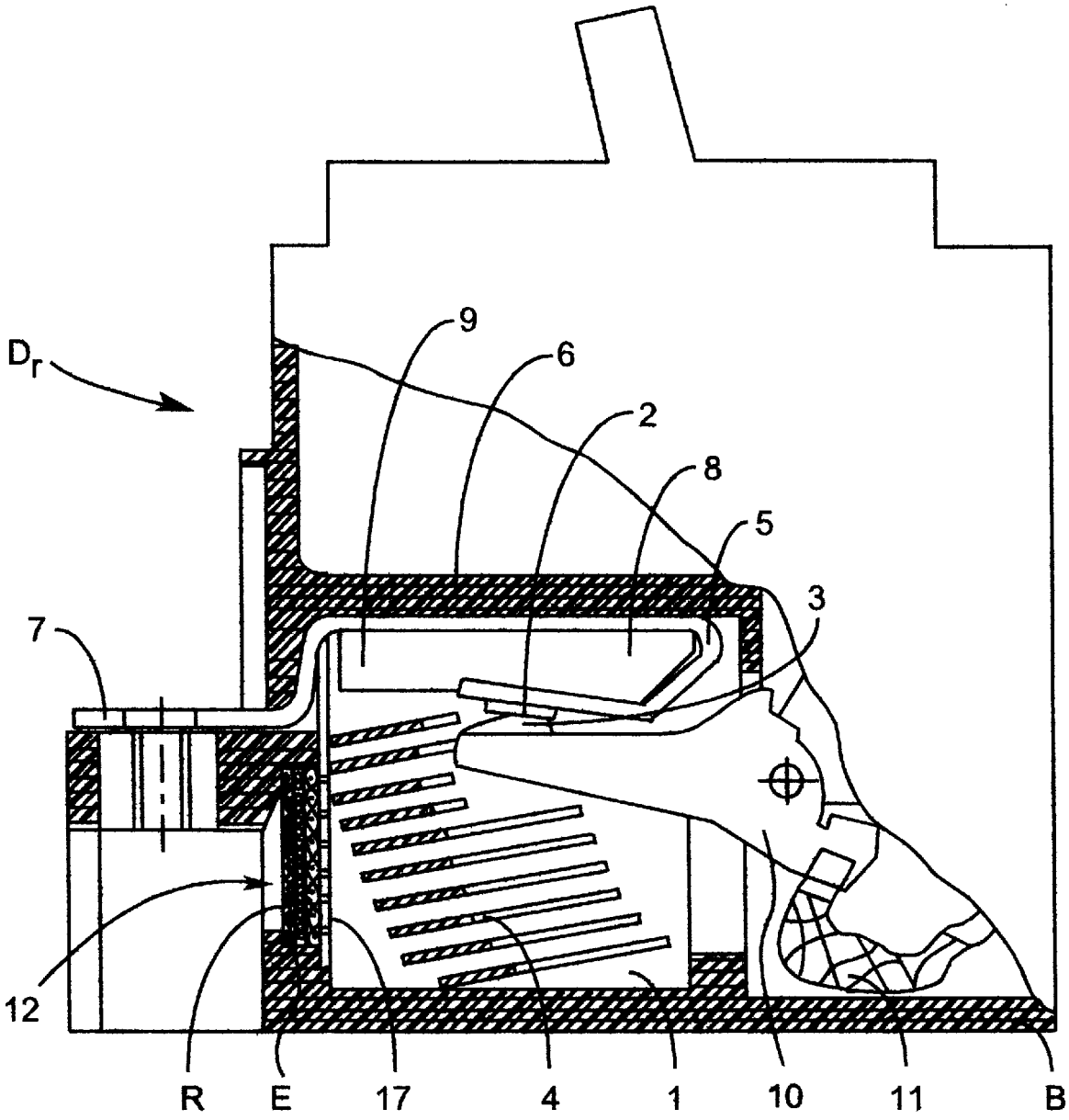
FIG. 1 is a longitudinal sectional view of an arc extinguishing chamber according to the invention belonging to a molded case circuit breaker represented partially tom away.

In FIG. 1, a low voltage multipole circuit breaker Dr can be seen with a case made from molded insulating material and a manual operating handle. This circuit breaker Dr comprises per pole an arc extinguishing chamber 1 housed in a lower compartment of the case B.

Each arc extinguishing chamber 1 comprises a pair of separable contacts 2, 3 and a stack of cooling plates 4 with V-shaped notches extending transversely to the direction of extension of the arc drawn between the contacts 2, 3 when separation of the latter takes place after the circuit breaker has tripped. The stationary contact 2 is supported by a conductor 5 in the form of a U-shaped pin positioned on an intermediate wall 6 of the case B and in electrical connection with an external connection strip 7. A metallic shielding element 8 is inserted between the two branches of the pin of the conductor 5 and is provided with an extension 9 acting as end separator. The movable contact 3 is securedly united to a contact arm 10 associated to a pivoting bar of the actuating mechanism (not represented) common to all the poles. A braided connecting strap 11 connects the opposite end of the arm 10 to the thermal and electromagnetic tripping elements (not represented) of each pole. The transverse face of the lower compartment of the case B is provided with an orifice 12 for outlet of the breaking gases arranged at the outlet of each arc extinguishing chamber 1.

According to the invention, a gas deionization device, designated by the general reference R, is disposed in each outlet orifice 12 to reduce the external manifestations of the ionized gases by means of an efficient cooling of the hot gases at the outlet of the chamber 1. Each deionization device R cooperates with the plates 4 and comprises a porous shield E formed by juxtaposition of several metallic cloths called wire T rep cloths.

These wire T rep cloths are constituted in general manner by a criss-crossing of straight wire yarns 15 spaced apart from and parallel to one another with tight joined undulated wire yarns 16 passing alternately over and under one or more of the successive straight wire yarns 15, and extending appreciably perpendicularly to said straight wire yarns 15.

Figure 2A:
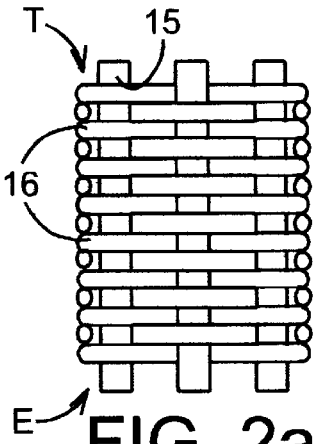
FIGS. 2*a,* 2*b* and 2*c* illustrate respectively a top view, a cross sectional view and a side view of a cloth called weft reps according to a particular embodiment of the invention.
Figure 2B:
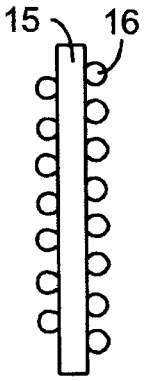

These wire T reps cloths may have different structures i.e. for instance an even reps structure or a crossed reps structure. According to the even reps structure represented in FIGS. 2*a,* 4*a* and 6*a.* The wire T rep cloth is formed by parallel straight wire yarns 15 and undulated wire yarns 16 passing alternately over and under the successive straight wire yarns 15, one at a time, and each time with staggering of a straight wire yarn 15 with respect to the previous undulated wire yarn, that is to say that two adjacent undulated wire yarns 16 pass respectively over and under the same straight wire yarn 15.

Figure 3A:
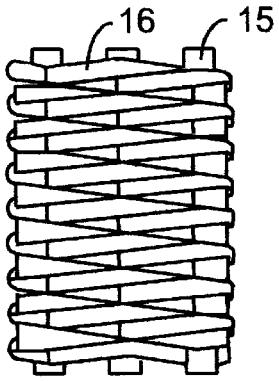
FIGS. 3*a,* 3*b* and 3*c* illustrate respectively a top view, a cross sectional view and a side view of a cloth called crossed weft reps according to another embodiment of the invention.
Figure 3B:
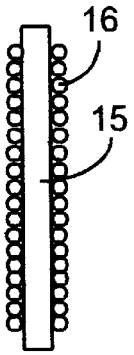
Figure 2C:
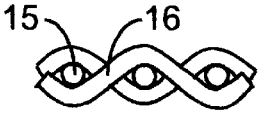
Figure 3C:
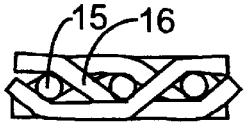
Figure 4A:
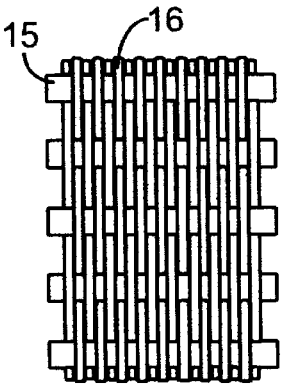
FIGS. 4*a,* 4*b* and 4*c* illustrate respectively a top view, a cross sectional view and a side view of a cloth called even wrap reps according to another embodiment of the invention.
Figure 4B:
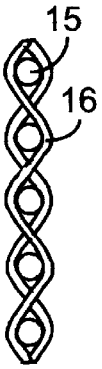
Figure 5A:
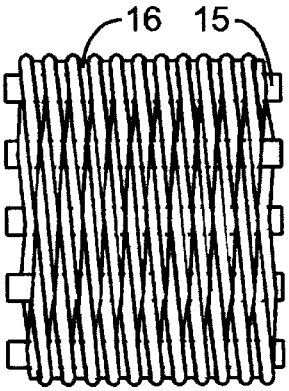
FIGS. 5*a,* 5*b* and 5*c* illustrate respectively a top view, a cross sectional view and a side view of a cloth called crossed wrap reps according to another embodiment of the invention.
Figure 5B:
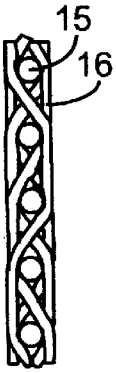
Figure 4C:
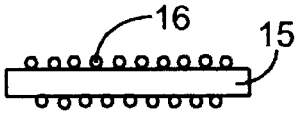
Figure 5C:
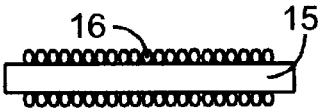
Figure 6:
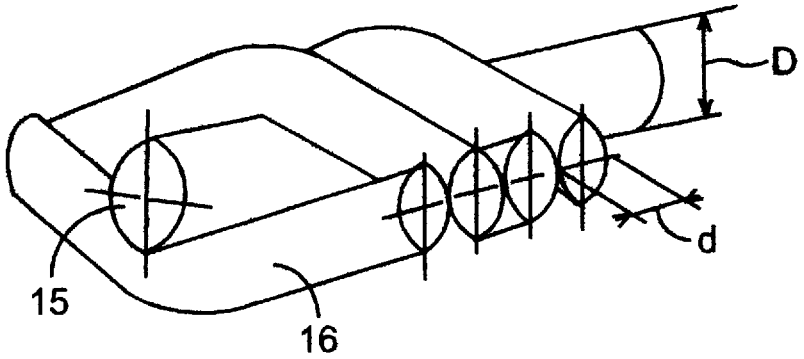
FIG. 6 is a partial perspective schematic view illustrating a straight weft yarn and two adjacent undulated wrap yarns of an even reps cloth.

According to the crossed reps structure as illustrated in FIGS. 3*a* and 5*a,* each wire T rep cloth T is formed by straight wire yarns 15 and undulated wire yarns 16, each undulated wire yarn 16 passing alternately over and under two straight wire yarns 15 at a time with staggering of a straight wire yarn 15 with respect to the previous undulated wire yarn, the undulated wire yarns 16 being criss-crossed.

Figure 9:
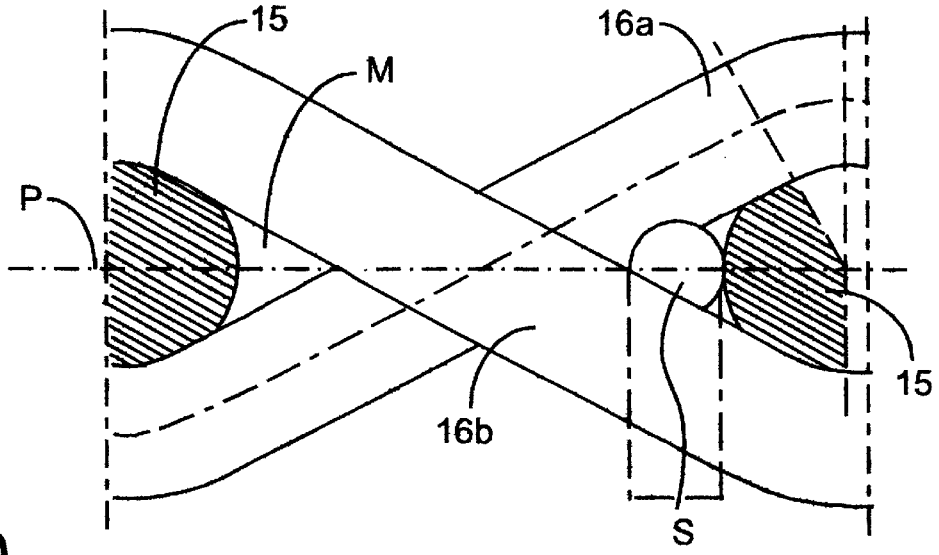
FIGS. 9, 10 and 11 are partial cross-sectional views illustrating two triangular meshes associated respectively to an even wrap reps cloth, to a crossed wrap reps cloth and to an even wrap reps cloth of high porosity.
Figure 10:
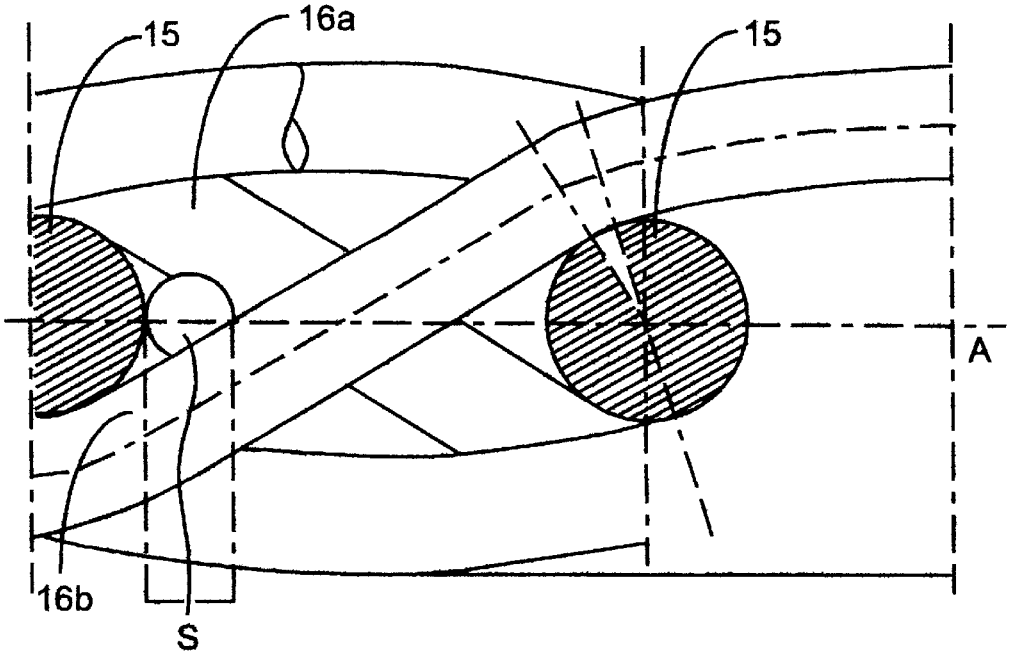
Figure 11:
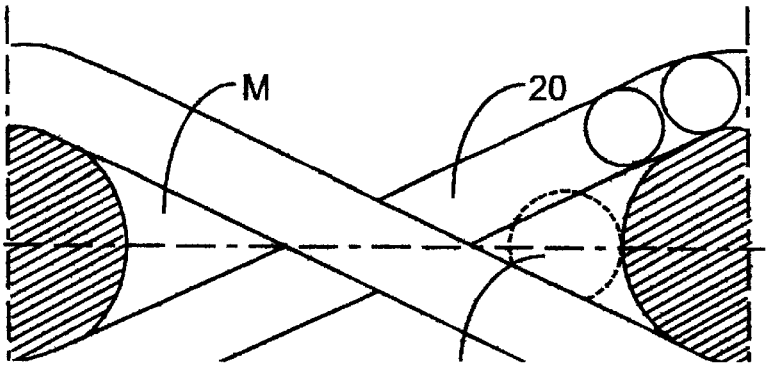

The parameters defining these structures are among others the diameters of the straight wire yarns 15 and undulated wire yarns 16, the spacing apart (or pitch) of the straight wire yarns 15, the nominal opening or mesh gap which corresponds, as illustrated in FIGS. 9, 10, 11 to the diameter of the sphere S tangent to the wire yarns 16*a,* 16*b* forming the mesh. Advantageously, the diameter d of the undulated wire yarns 16 is smaller than the diameter D of the straight wire yarns 15. This weaving enables mesh openings to be obtained which are considerably smaller than the diameter d, D of the wire yarns 15, 16 forming the cloth.

Advantageously, the porous shield E is formed by several wire T rep clots as previously described, stacked on one another (advantageously between 2 and 5 cloths). These juxtaposed wire rep T cloths have progressive mesh openings, the wire rep T cloth having the largest openings, i.e. the diameter of the wire yarns is greater, being situated in such a way that the gases pass through it first. This first cloth thus presents a high thermo-mechanical strength necessary for the first element filtering the breaking gases, whereas the last element presents a minimum mesh opening necessary for maximum cooling of the breaking gases. For this purpose, the diameters d, D of the wire yarns (undulated and straight) associated to the first cloth are greater than 0.5 mm and the nominal opening greater than 400 $\mu$m, whereas the nominal mesh opening associated to the last cloth is less than 200 $\mu$m.

It should moreover be noted that the progressive decrease of the nominal openings procures a better mastery of the pressure rise in the arc extinguishing chamber.

Referring to FIG. 1, it can be seen that an additional shield 17 made of insulating material is advantageously placed in the outlet zone of the arc extinguishing chamber 1 in the gap arranged between the ends of the plates 4 and the porous shield E according to the invention.

This insulating shield 17 arranged facing the porous shield E presents a regular and perfectly defined perforation allowing flow of the gases. This shield 17 is designed to prevent the arc from looping back onto the metallic elements of the filter.

It should also be noted that perforated plates or stiffeners (not represented) could be added on each side of the porous shield E. These perforated plates will enable stirring of the gas to be achieved and will increase the mechanical strength of the assembly in order to resist the pressure wave associated with breaking of the short-circuit currents.

Thus, in operation, when breaking of the arc takes place in the extinguishing chamber 1, the breaking gases after they have passed through the insulating shield 17 are efficiently cooled through the porous shield E.

Figure 7:
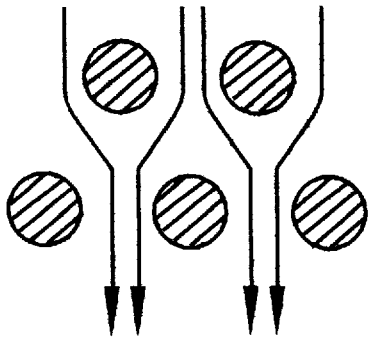
FIGS. 7 and 8 illustrate schematically the path of the gas through respectively two superposed reps cloths and four superposed reps cloths.
Figure 8:
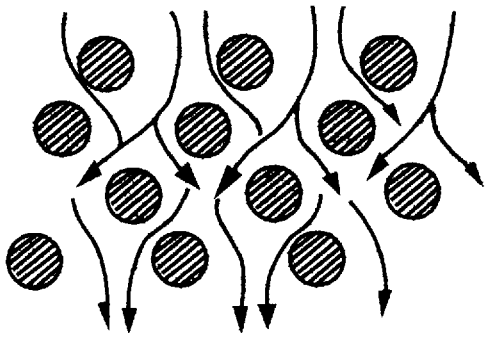

The ionized gases in fact pass through the meshes M formed in the different layers of cloth, each mesh M being defined as can be seen more particularly in FIGS. 9 to 11, whatever the structure of the cloth, even reps or crossed reps texture, by a straight wire yarn 15 and two undulated wire yarns 16 tangent to one another in the mid-plane p of the cloth. The ionized gas flows through these passages of minimum cross section and is greatly disturbed in terms of direction and velocity. FIGS. 7 and 8 should be referred to to observe the path of the gas respectively in an even wire reps texture cloth and a crossed wire reps texture cloth. The heat exchanges between the gases and the wire yarns 15, 16 constituting the shield E, and therefore their deionization by cooling, are thus enhanced. It should be noted that it is necessary for the wire T rep cloth to keep a certain porosity in order to enable an outflow of the gases thus limiting the overpressure occurring in the apparatus. It will therefore be necessary to find a compromise between the exhaust cross section and the heat exchange surface.

In comparison to traditional square-mesh metallic cloths, these wire cloths enable considerably finer mesh openings than the diameter of the wire yarns of the wire cloth to be obtained. It is then possible to combine in the same filter a good thermo-mechanical strength and a large heat exchange surface necessary for cooling.

It should be noted that particular reps cloth structures can be envisaged such as for instance the high-porosity reps cloth as illustrated in FIG. 11, in which the finest wire yarns 20 are of smaller diameter than the diameter of the sphere S tangent to the wire yarns forming the mesh M.

The material constituting the wire yarns may be any metallic material which is heat-conducting and corrosion-resistant such as stainless steel or nickel.

The number of superposed cloths is varied according to the arc energy developed in the arc extinguishing chamber. For example, for an energy of 200 kJ, four thicknesses will be used.

Naturally the invention is not limited to the embodiments described and illustrated which have been given to serve as examples only.

On the contrary, the invention comprises all the technical equivalents of the means described and any combination thereof if the latter are performed within the spirit of the invention.

We claim:

1. A gas deionization device to cool and deionize gases from an arc extinguishing chamber of a circuit breaker, comprising:

a porous shield located between an arc extinguishing chamber of a circuit breaker and an outlet orifice for gas in the arc extinguishing chamber;

said porous shield comprises at least one wire rep cloth comprising a plurality of straight wire yarns and tightly joined undulated yarns, said plurality of straight wire yarns being spaced apart and parallel to each other, and said tightly joined undulated wire yarns extend substantially perpendicular to said plurality of straight wire yarns; and said tightly joined undulated wire yarns alternately pass under and over at least one of said plurality of straight wire yarns.

2. The device according to claim 1, wherein said at least one wire rep cloth is made of a corrosion-resistant metallic material selected from the group consisting of stainless steel and nickel.

3. The device according to claim 1, wherein each wire rep cloth comprises a substantially triangular mesh for passage of the gas with openings therein defined by a straight wire yarn and two undulated wire yarns tangent to one another in a mid-plane of said wire rep cloth.

4. The device according to claim 1, wherein said at least one wire rep cloth comprises tightly joined undulated wire yarns passing alternately over and under a single straight wire yarn at a time, and arranged two by two so that when one undulated wire yarn passes over a straight wire yarn, a second undulated wire yarn passes under this same straight wire yarn.

5. The device according to claim 1, wherein said at least one wire rep cloth comprises said tightly joined undulated wire yarns passing alternately under and over two of said straight wire yarns at a time, with an offset of a straight wire yarn with respect to a previous tightly joined undulated wire yarn, the tightly joined undulated wire yarns being imbricated.

6. The device according to claim 1, wherein said tightly joined undulated wire yarns are weft yarns.

7. The device according to claim 1, wherein a diameter of said tightly joined undulated wire yarns is smaller than a diameter of said plurality of straight wire yarns.

8. The device according to claim 1, comprising at least two superposed wire rep cloths having wire mesh openings of different sizes.

9. The device according to claim 1, comprising at least three superposed wire rep cloths having progressively differently sized mesh openings, the rep cloth having the largest mesh openings being a first wire rep cloth, through which gas from the arc extinguishing chamber first passes.

10. The device according to claim 9, wherein said first wire rep cloth has a diameter of tightly joined undulated and straight yarns greater than 0.5 mm and a nominal opening greater than 400 $\mu$m, a third cloth presents a nominal opening smaller than 200 $\mu$m.

11. An arc extinguishing chamber in an isolating molded case of a multiple circuit breaker each pole comprising:

a pair of separable contacts, a first separable contact being a stationary contact and a second separable contact being a movable contact;

said movable contact comprises an actuating mechanism;

metallic cooling plates to cool the arc between said pair of separable contacts after separation;

an orifice outlet, said orifice outlet in communication with the arc extinguishing chamber to allow circuit breaking gas to vent; and a deionization device according to claim 1 located between said orifice outlet and said arc extinguishing chamber so that said deionization device cools and deionizes circuit breaking gases venting through said orifice outlet.

12. The arc extinguishing chamber according to claim 11, further comprising at least one perforated shield made of insulating material located between ends of the metallic cooling plates and the porous shield.

13. The arc extinguishing chamber according to claim 11, said arc extinguishing chamber comprising at least one of perforated plates and stiffeners placed on each side of the porous shield to increase its mechanical resistance to a pressure wave.

* * * * *